US009049914B2

(12) United States Patent
Sze

(10) Patent No.: US 9,049,914 B2
(45) Date of Patent: Jun. 9, 2015

(54) HAIR CLIPPING DEVICE

(71) Applicant: TUNG HING PLASTIC MANUFACTORY LTD., Kowloon (HK)

(72) Inventor: Ka Chuen Sze, Hong Kong (HK)

(73) Assignee: Tung Hing Plastic Manufactory Ltd., Cheung Sha Wan, Kowloon (HK)

( * ) Notice: Subject to any disclaimer, the term of this patent is extended or adjusted under 35 U.S.C. 154(b) by 0 days.

(21) Appl. No.: 13/717,858

(22) Filed: Dec. 18, 2012

(65) Prior Publication Data

US 2014/0166040 A1 Jun. 19, 2014

(51) Int. Cl.

| | |
|---|---|
| ***A45D 8/20*** | (2006.01) |
| ***A45D 8/26*** | (2006.01) |
| ***A45D 8/30*** | (2006.01) |

(52) U.S. Cl.

CPC .. *A45D 8/20* (2013.01); *A45D 8/26* (2013.01); *A45D 8/30* (2013.01)

(58) Field of Classification Search

CPC ..... A45D 8/24; A45D 8/16; A45D 8/14; A45D 8/34

USPC ..... 132/273–274, 276–279; 24/499–500, 24/507, 509, 521; D28/39–43

See application file for complete search history.

(56) References Cited

U.S. PATENT DOCUMENTS

| | | | | | |
|---|---|---|---|---|---|
| 5,477,870 | A * | 12/1995 | Menaged | 132/279 |
| 5,605,166 | A * | 2/1997 | Chou | 132/279 |
| 6,023,818 | A * | 2/2000 | Shang | 24/501 |
| 6,142,158 | A * | 11/2000 | Lloyd et al. | 132/275 |
| 6,311,699 | B1 * | 11/2001 | Horman | 132/278 |
| 6,981,507 | B2 * | 1/2006 | Gabriele-Baumann | 132/275 |
| 7,356,889 | B2 * | 4/2008 | Alitowski | 24/521 |
| 7,461,661 | B2 * | 12/2008 | Chudzik et al. | 132/273 |
| 7,766,020 | B2 * | 8/2010 | Chininis et al. | 132/278 |
| 7,882,884 | B2 * | 2/2011 | Beals et al. | 164/132 |
| 8,061,369 | B2 * | 11/2011 | Kim | 132/277 |
| 2004/0065341 | A1 * | 4/2004 | La Fauci | 132/277 |
| 2007/0256701 | A1 * | 11/2007 | Benz | 132/278 |
| 2008/0023022 | A1 * | 1/2008 | Chudzik et al. | 132/279 |
| 2008/0142035 | A1 * | 6/2008 | Hsu | 132/279 |
| 2009/0223533 | A1 * | 9/2009 | Daley | 132/211 |

* cited by examiner

*Primary Examiner* — Rachel Steitz
*Assistant Examiner* — Jennifer Gill
(74) *Attorney, Agent, or Firm* — Heslin Rothenberg Farley & Mesiti P.C.; Victor A. Cardona

(57) ABSTRACT

The present invention is concerned with a hair clipping device. The device has a first member in the form of an arm, and defines an inwardly facing surface. The device has a second member also in the form of an arm, movably connected to the first member and defines an inwardly facing surface. The device further has a bridge, the bridge has a frame portion made of a first material and an interior portion made of a second material. The interior portion is softer than the frame portion and provided with an increased frictional surface when compared to said frame portion.

11 Claims, 32 Drawing Sheets

FIG. 2a
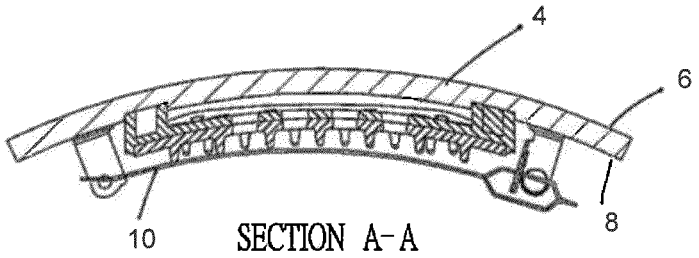
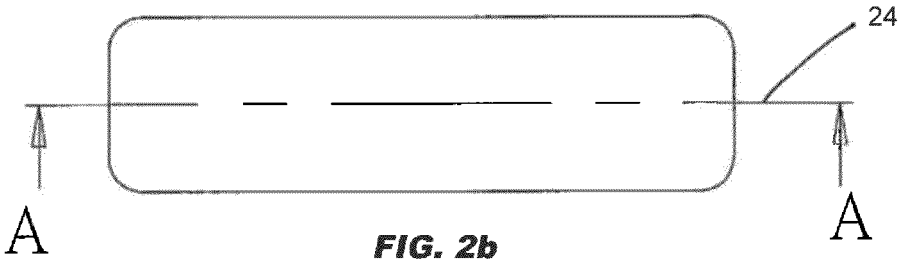
FIG. 2b
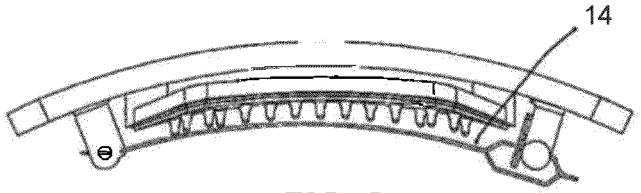
FIG. 2c
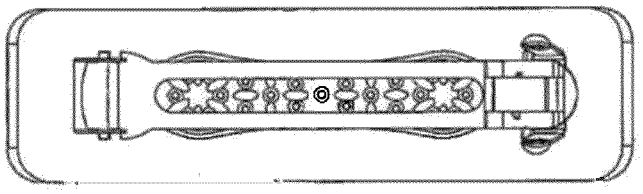
FIG. 2d

SECTION A-A

SECTION A-A

SECTION A-A

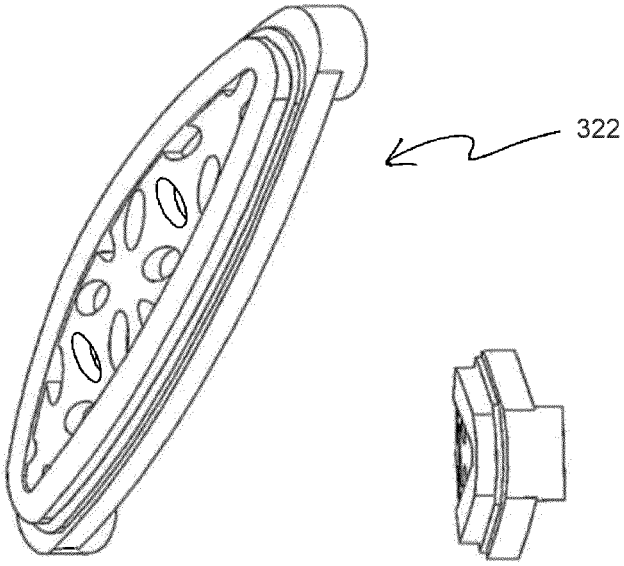
FIG. 30a
FIG. 30b
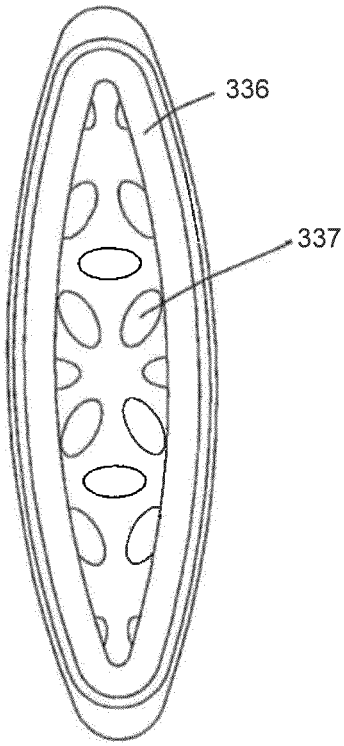
FIG. 30c
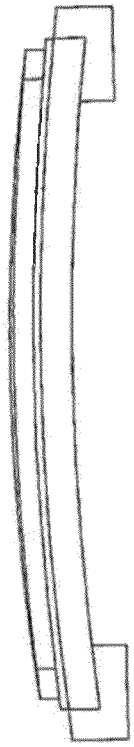
FIG. 30d
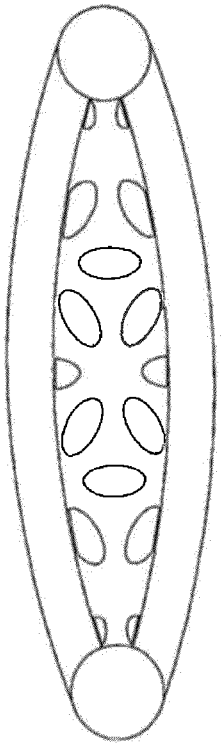
FIG. 30e

HAIR CLIPPING DEVICE

FIELD OF THE INVENTION

The present invention is concerned with a hair clipping device, including but not limited to a hair barrette and hair clipping claws.

BACKGROUND OF THE INVENTION

There is a variety of hair clipping devices in the market. While they are effective in managing hair to some extent, they are often unable to hold hair in shape for a long period of time. In another extreme, some of the hair clips tend to tangle with the hair such that removal of the clips becomes difficult, often resulting damage to the hair.

The present invention seeks to address these issues, or at least to provide an alternative to the public.

SUMMARY OF THE INVENTION

According to a first aspect of the present invention, there is provided a hair clipping device comprising a first member defining an inwardly facing surface, a second member movably connected to the first member and defining an inwardly facing surface, and a bridge, wherein the bridge includes a frame portion made of a first material and an interior portion made of a second material, and wherein the interior portion is softer than the frame portion and provided with an increased frictional surface when compared to the frame portion.

Preferably, the bridge may be arranged on but raised from the inner facing surface of the first member, and wherein the interior portion is provided with, an enhanced profile for increasing friction for hair gripping in use. The bridge may be elongate in shape and may run along a longitudinal axis of the hair clipping device. The bridge may be attached to the first member at opposite ends of the bridge. The device may comprise a pair of connectors acting a pair of feet for attachment of the bridge to the first member.

In an embodiment, the device may be configured such that a clearance is defined between the bridge and the first member. In a specific embodiment, the bridge may be slightly flexible towards the inwardly facing surface of the first member when under pressure from hair during hair clipping, and wherein the bridge may be mechanically biased towards hair being held and/or the second member. In this respect, the bridge may be mechanically springy.

In one embodiment, the first material may be a plastic material selected from a group including ABS, PP, HIPS, GPPS, PE, Nylon, polycarbonate, K-resin, acetal, cellulose acetate, PVC, PET and PLA, or a metallic material selected from a group of steel, brass and aluminium or a combination; and wherein said second material is selected from a group of TPE, TPR, silicone, rubber, PVC and EVA.

In another embodiment, the bridge may be formed by double injection in which the interior portion may be molded to the frame portion previously molded. Alternatively, the frame portion and the interior portion may be connected together by snap-fitting and/or gluing.

In a specific embodiment, the bridge may be provided with a number of spikes pointing away from the inwardly facing surface of the first member and/or towards the second member for increased grip of hair by the spikes and/or between the bridge and the second member. Additionally or alternatively, the bridge may be provided with a number of apertures thereon.

Advantageously, the bridge member may be connected to the first member by a methodology selected from a group including sonic welding, laser welding, screw fastening, heat pressing, cold pressing, heat pivoting and gluing.

In a specific embodiment, the elongate bridge may have a length ranging from substantially 18 mm to 40 mm.

Suitably, the device may comprise a hinge at one end thereof for connecting the first member and the second member together allowing the device to swing open from one end for receiving a lock of hair in use. The device may comprise a locking means at the opposite end for locking the first member and the second member together, thus allowing the log of hair be secured therebetween.

In one embodiment, the device may generally be in the form of a barrette.

In another embodiment, the first member and the second member generally resemble a pair of claws for holding a lock of hair together. In a specific embodiment, the device may comprise two bridges arranged on the first member and the second member, respectively, wherein the position of the bridges is such that on assembly of the first and second members, the bridges cooperatively secure a lock of hair therebetween.

BRIEF DESCRIPTION OF THE DRAWINGS

Some embodiments of the present invention will now be explained, with reference to the accompanied drawings, in which:

FIGS. 2*a* to 2*d* are a cross section view, a top view, the opposite side view and a bottom view of the hair clip of FIG. 1*a*, respectively;

FIGS. 30*a* to 30*e* are a perspective view, a side view, a top view, another side view and a bottom view of a bridge member of the hair clip of FIG. 24*a*, respectively;

DETAILED DESCRIPTION OF PREFERRED EMBODIMENTS OF THE INVENTION

The present invention is concerned with hair clipping device, and is illustrated and explained by way of examples below.

A first embodiment of a hair clipping device, or a hair clip, is shown in FIGS. 1*a* to 7. The hair clip, generally designed 2, is in the form of a barrette.

Figure 1A:
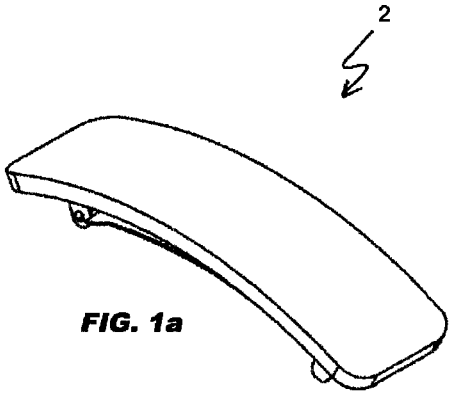
FIGS. 1*a* to 1*c* are a first perspective view, a side view and a second perspective view of an embodiment of a hair clip, respectively.
Figure 1B:
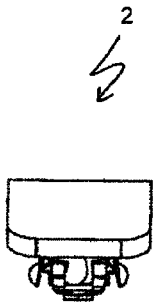
Figure 1C:
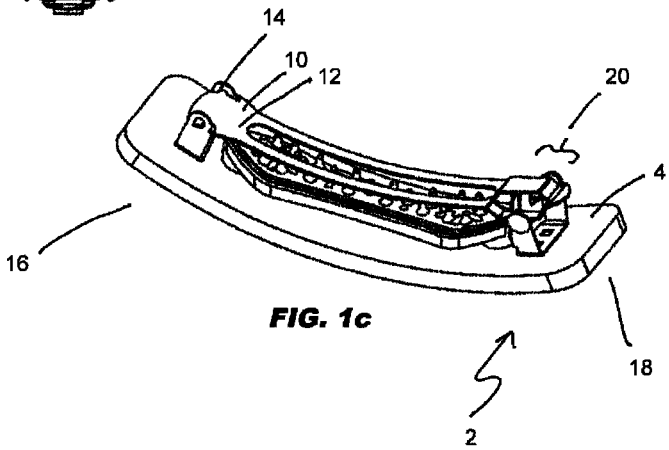

FIGS. 1*a* and 1*c* are perspective view of the hair clip 2. The clip 2 has a generally elongate profile and a first member 4 which is typically exposed in use. Specifically, the first member 4 defines an outwardly facing surface 6 and an inwardly facing surface 8 during normal use. The clip 2 has a second member 10 which is usually concealed in the hair of a user in use. The second member 10 likewise has an outwardly facing surface 12 and an inwardly facing surface 14. The first member 4 is wider and longer such that the second member 10 is covered by the first member 4 when the clip 2 is worn by a user in normal use. The first member 4 and the second member 10 are pivotably connected at one end 16 of the clip 2 by a hinge 14 such that the first member 4 and the second member 10 can be opened for receiving a lock of hair at the hinge 14. The first member 4 and the second member 10 are removably locked together (or unlocked) at the opposite end 18 of the clip 2 by a locking means 20.

FIGS. 2*a* to 2*d* show that the clip 2 is provided with a member 22 generally in the form of a bridge arranged on and connected to the first member 4.

Figure 3:
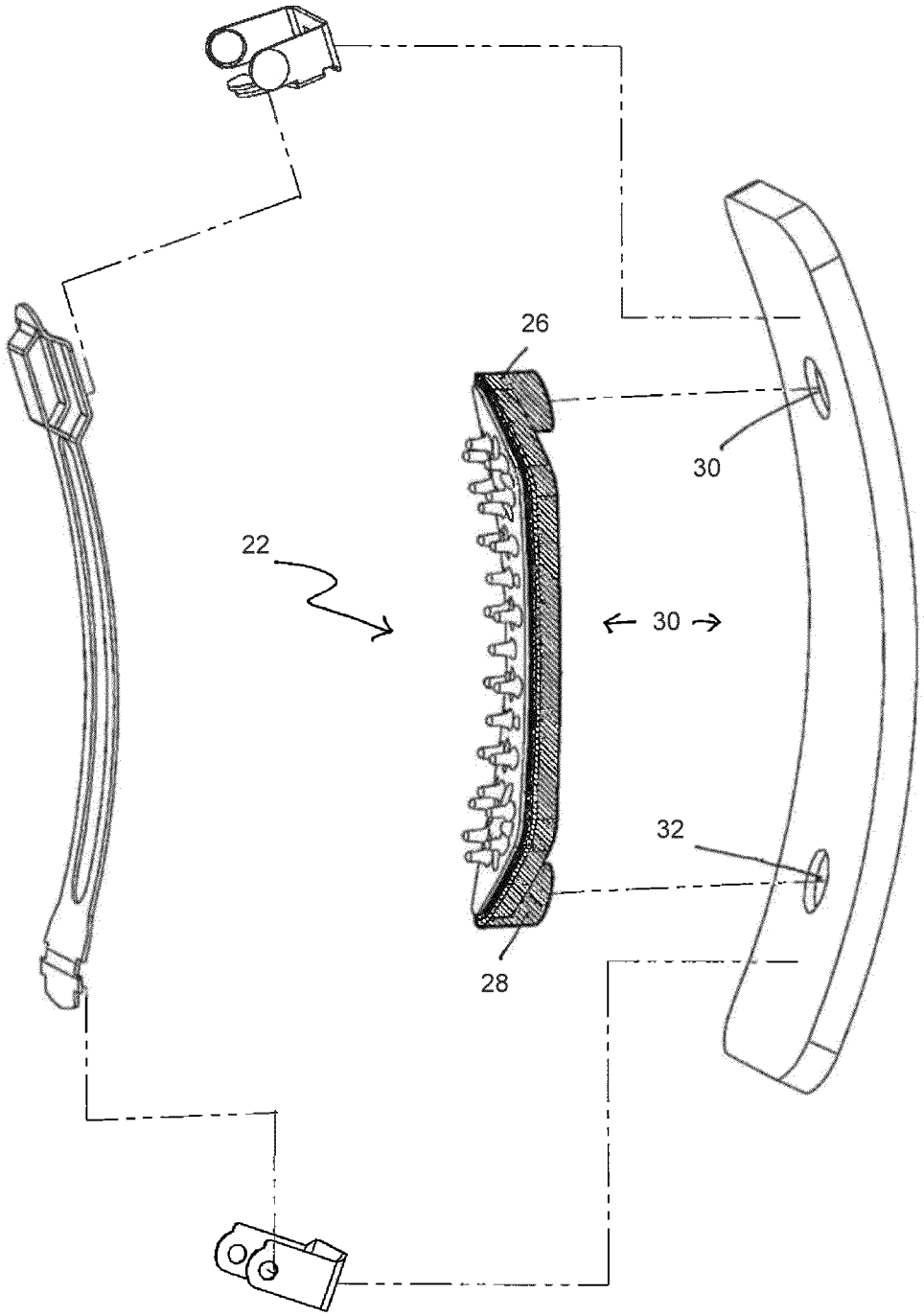
FIG. 3 is an exploded view of the hair clip of FIG. 1*a;*

FIG. 3 is an exploded view of the clip more clearly showing the bridge member 22. The bridge member 22 likewise has an elongate profile and disposed along a longitudinal axis 24 of the clip 2. The bridge member 22 has a pair of connectors 26, 28 generally in the form of a pair of feet. The connectors 26, 28 have a cylindrical profile and are sized and shaped to fit within and secured to corresponding recesses 30, 32 provided on the inwardly facing surface 8 of the first member 4. It is to be noted that the first member 4 is slightly curved and the outwardly facing surface 6 is accordingly slightly convex while the inwardly facing surface 8 is slightly concave. The bridge member 22, as well as the second member 10 has a similar profile such that the entire clip 2 adopts this profile. It is also to be noted that the bridge member 22 is arranged on but raised from the inwardly facing surface 8 of the first member 4. Accordingly, there is a clearance 30 between the bridge member 22 and the first member 4.

Figure 4:
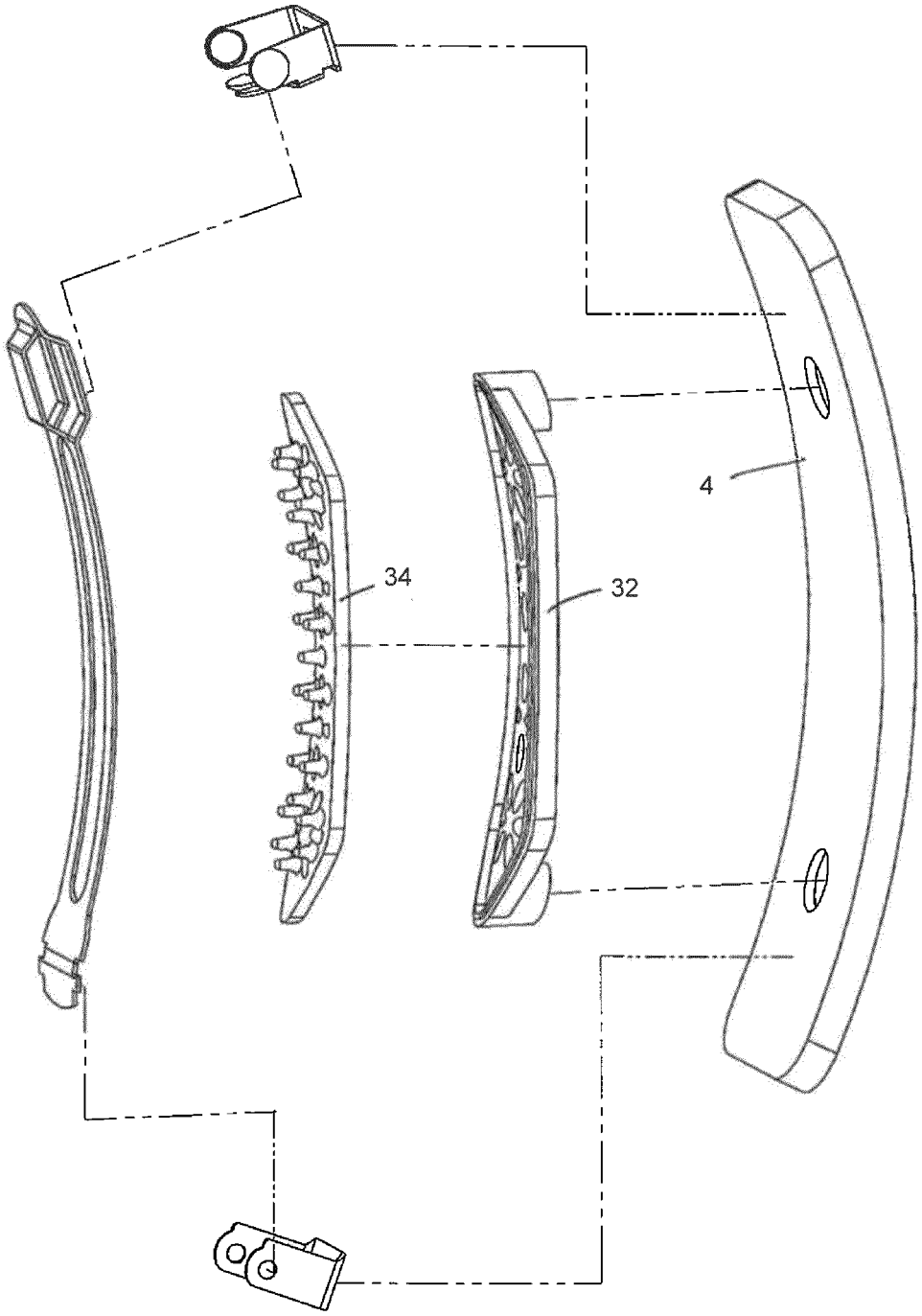
FIG. 4 is a further exploded view of the hair clip of FIG. 1*a;*
Figure 5A:
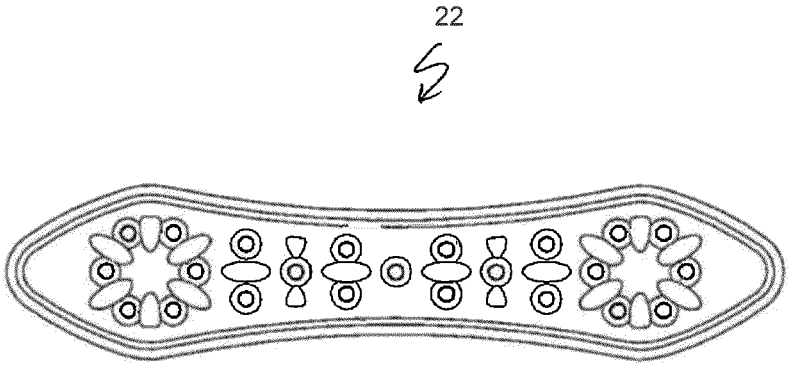
FIGS. 5*a* to 5*c* are a top view, a side view and a bottom view of a bridge member of the hair clip of FIG. 1*a* respectively.
Figure 5B:
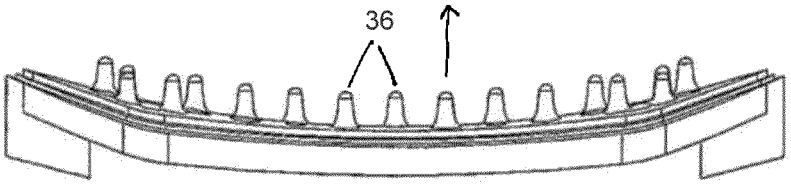
Figure 5C:
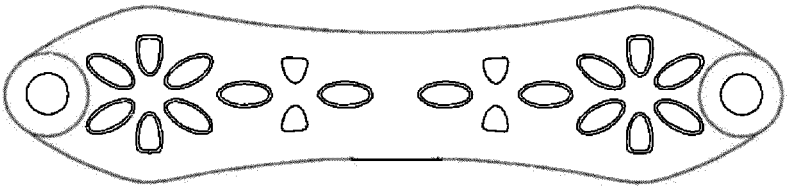
Figure 6A:
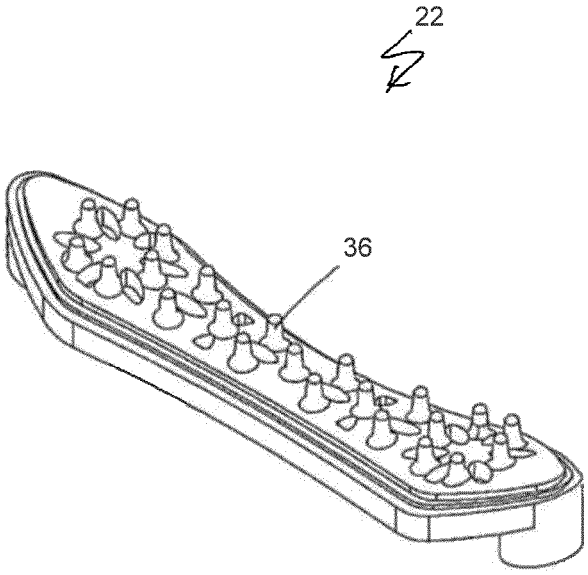
FIGS. 6*a* to 6*b* are a perspective view and a side view of the bridge member of FIG. 5*a;*
Figure 6B:
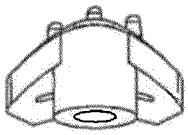

FIG. 4 is similar to FIG. 3 although the bridge member 22 is, further exploded for illustration. The bridge member 22 has two portions, namely a frame portion 32 and a frictional portion 34 positioned on and/or surrounded by the frame portion 32. The frame portion 32 has a higher rigidity when compared to the frictional portion 34 and provides the overall structure or support to the bridge member 22. The frictional portion 34 is softer and acts to provide an engagement surface for contact with hair being secured. Despite the difference in structure of the frame portion 32 and the frictional portion 34, the bridge member 22 as a whole when assembled has mechanically springy characteristic. While different materials may be used in making the frame portion 32 and the frictional portion 34, studies have shown that workable embodiments can make use of plastic(s) such as ABS, PP, HIPS, GPPS, PE, Nylon, polycarbonate, K-resin, acetal, cellulose acetate, PVC, PET and PLA, or metallic material such as steel, brass and aluminium as material for the frame portion 32, and can make use of plastic(s) such as TPE, TPR, silicone, rubber, PVC and EVA as material for the frictional portion 34.

In this embodiment, the bridge member 22 is made by double injection in which the frictional portion 34 is molded to the frame portion 32 previously molded. It is however to be noted that other suitable mode of assembly may be used. Once the bridge member 22 has been formed, it can be secured to the corresponding recesses 30, 32. In this embodiment, it is secured by sonic welding, although in other embodiment, laser welding, screw fastening, heat pressing, cold pressing, heat pivoting or gluing may be used.

FIGS. 5*a* to 6*b* show the profile of the bridge member 22 in greater detail. It is shown that the frictional portion 34 is provided with a number of spikes 36 pointing away from the inwardly facing surface 8 of the first member 4 towards the inwardly facing surface of the second member 14, as shown by the arrow in FIG. 5*b*. The spikes 36 are generally distributed across the surface of the bridge member 22 for better gripping technically but in a pattern that corresponds to the pattern of the bridge member 22 for aesthetic reason.

Figure 7:
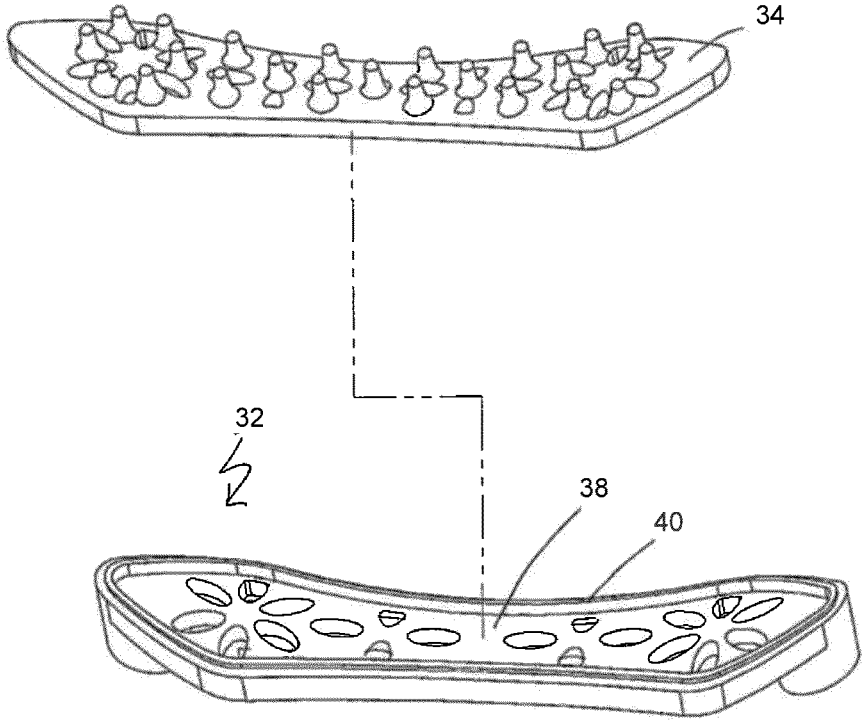
FIG. 7 is an exploded view of the bridge member of FIG. 5*a;*
Figure 8A:
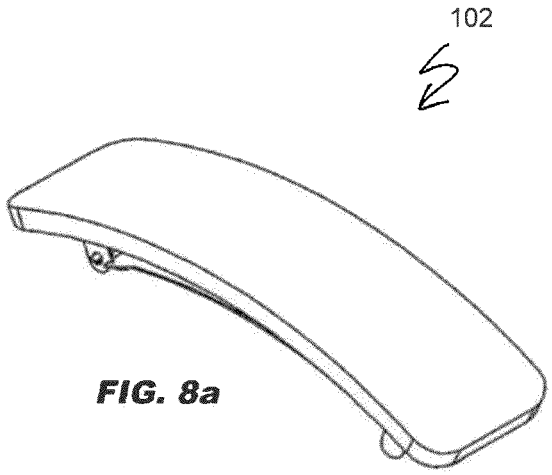
FIGS. 8*a* to 8*c* are a first perspective view, a side view and a second perspective view of another embodiment of a hair clip, respectively.
Figure 8B:
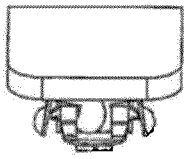
Figure 8C:
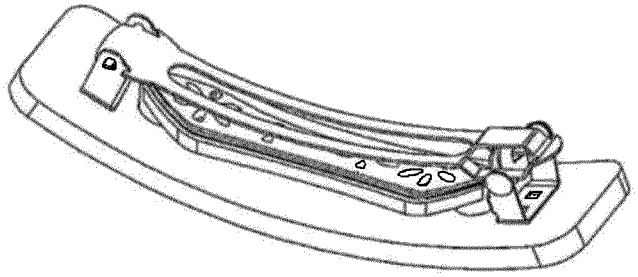
Figure 9A:
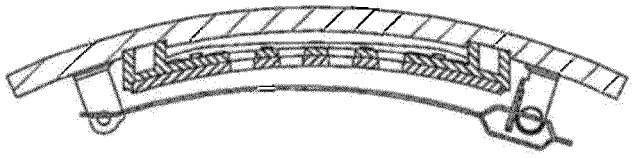
FIGS. 9*a* to 9*d* are a cross section view a top view, the opposite side view and a bottom view, respectively, of the hair clip of FIG. 8*a;*
Figure 9B:
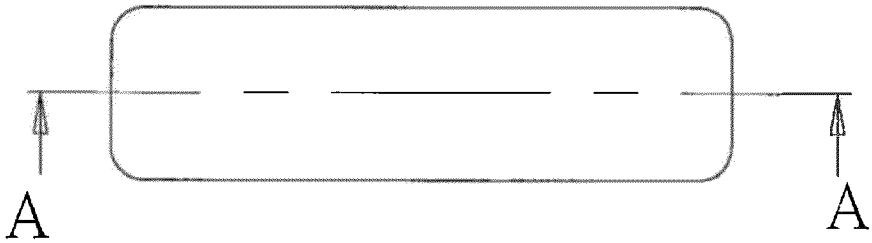
Figure 9C:
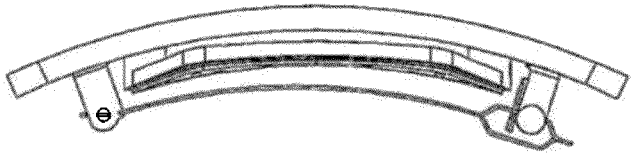
Figure 9D:
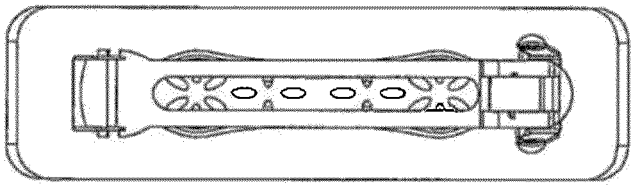
Figure 10:
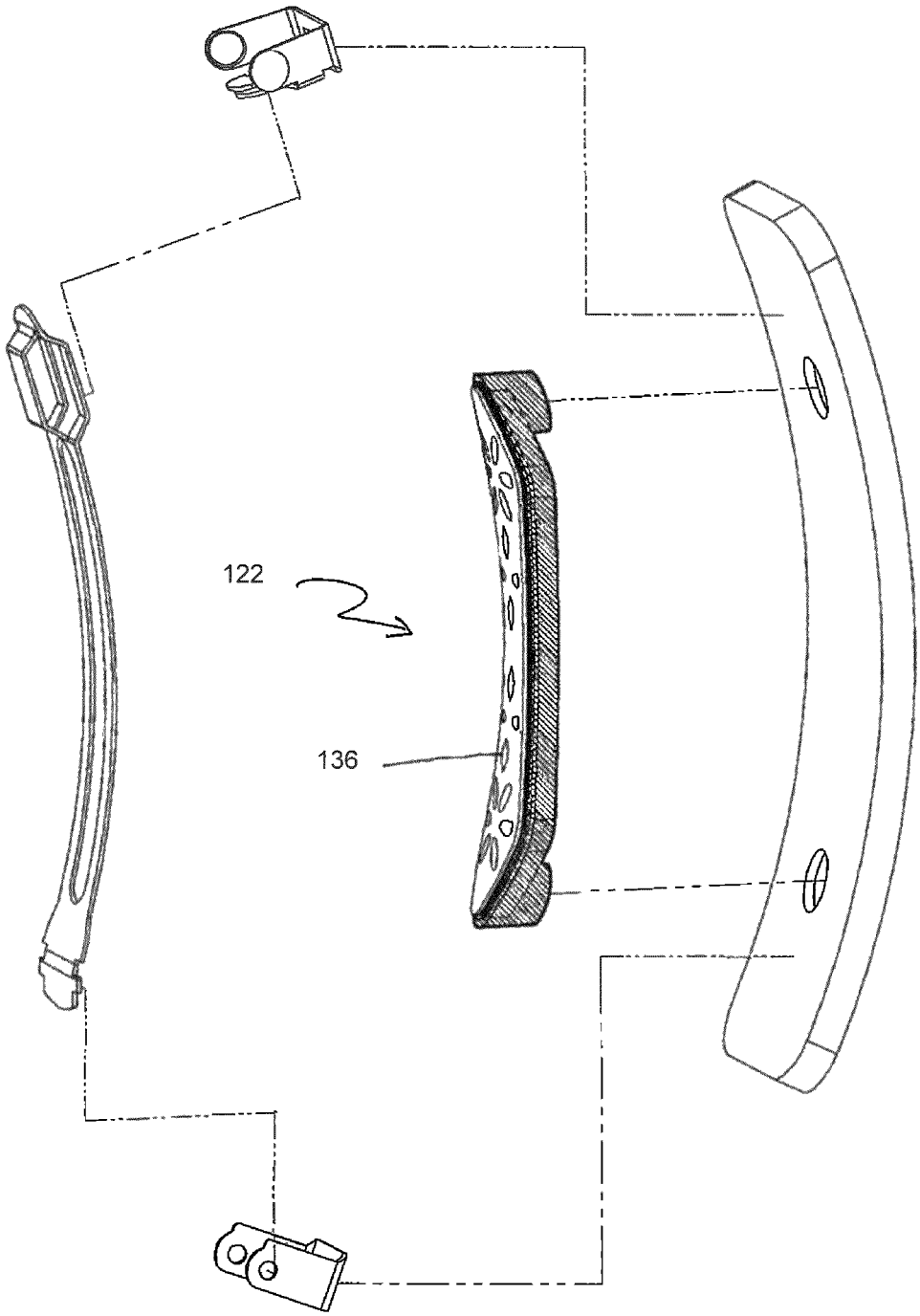
FIG. 10 is an exploded view of the hair clip of FIG. 8*a;*
Figure 11:
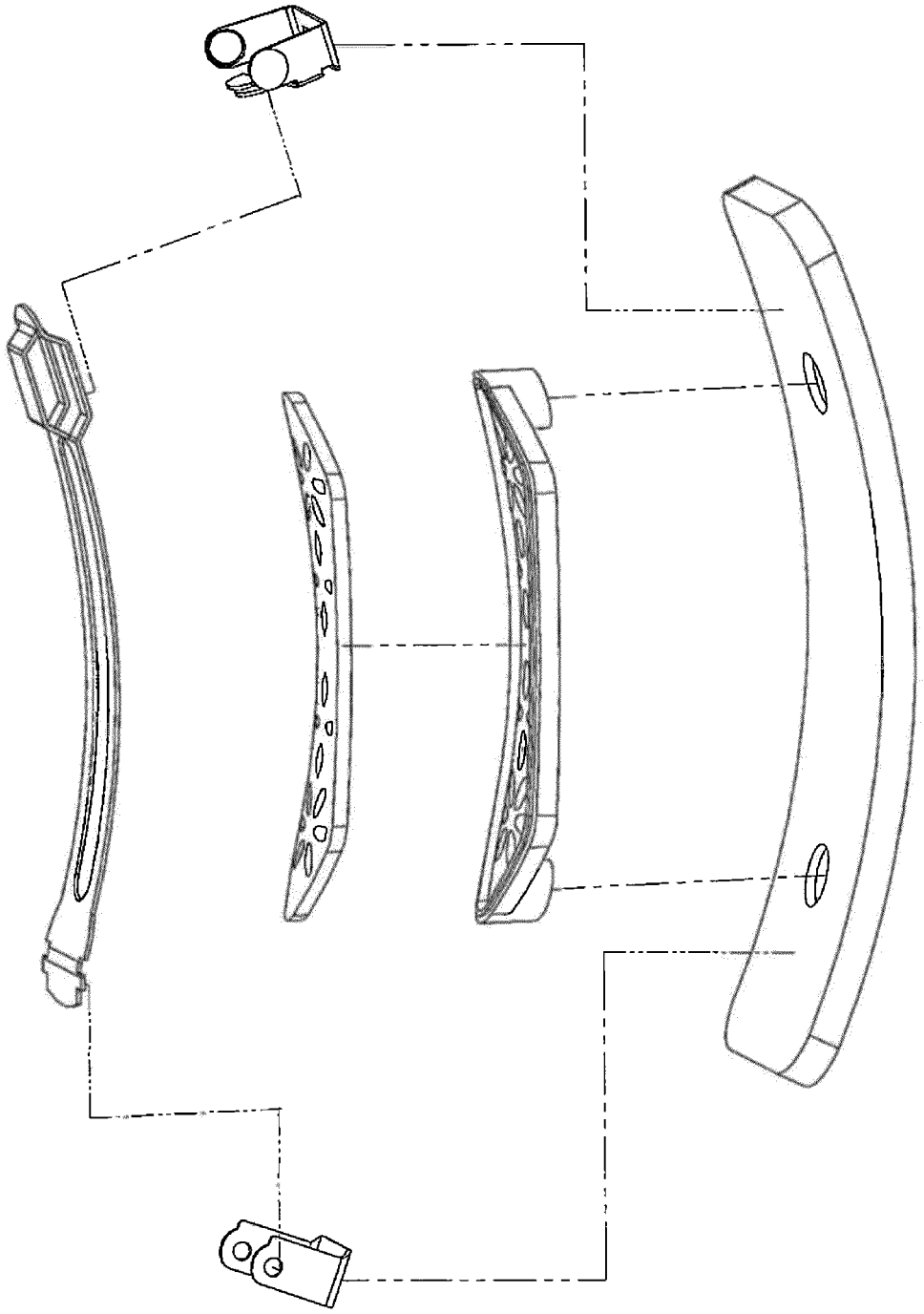
FIG. 11 is a further exploded view of the hair clip of FIG. 8*a;*
Figure 12A:
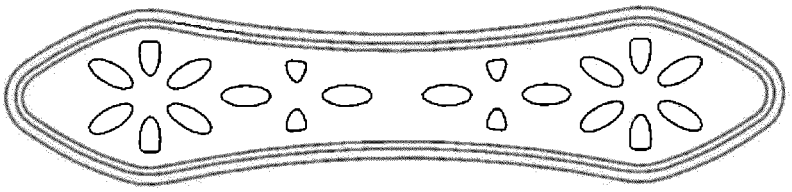
FIGS. 12*a* to 12*c* are a top view, a side view and a bottom view of a bridge member of the hair clip of FIG. 8*a*, respectively.
Figure 12B:
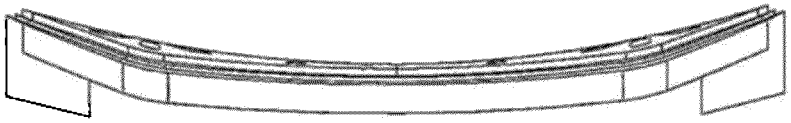
Figure 12C:
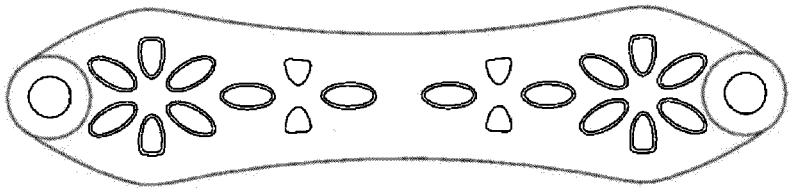
Figure 13A:
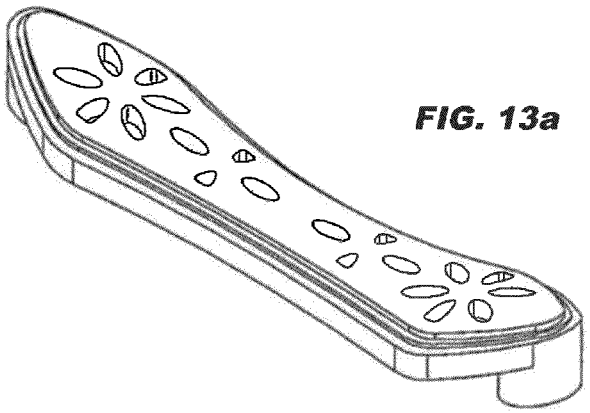
FIGS. 13*a* to 13*b* are a perspective view and a side view of the bridge member of FIG. 8*a;*
Figure 13B:
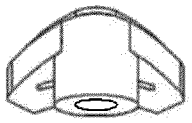
Figure 14:
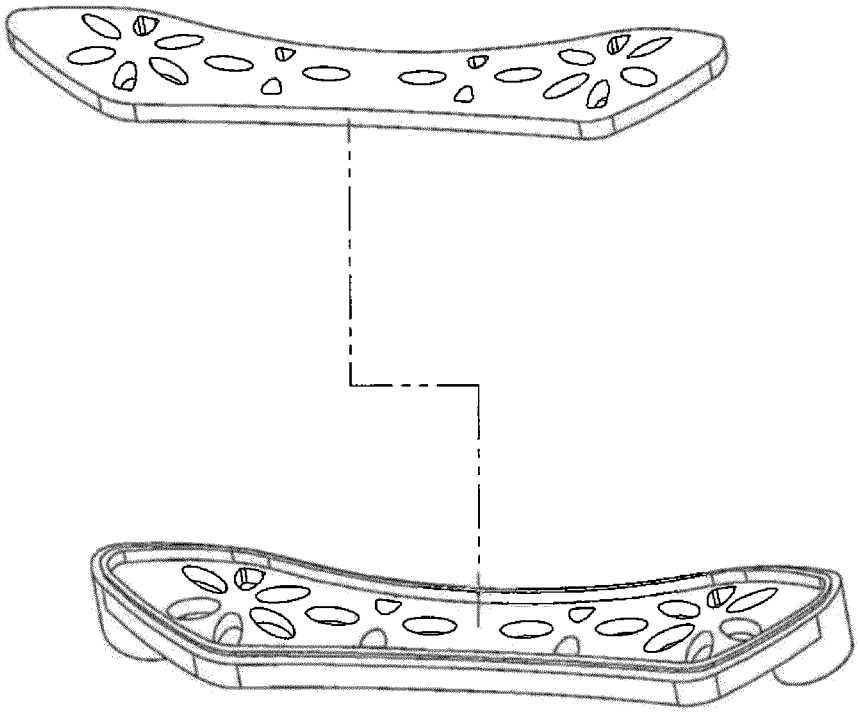
FIG. 14 is an exploded view of the bridge member of FIG. 8*a;*

FIG. 7 shows that in an alternative embodiment the frictional portion 34 may be secured to a recess 38 or within a boundary 40 defined by the frame portion 32.

Referring to FIGS. 1*c*, 2*a*, 2*c* and 2*d*, it is envisaged that, in use, a user unlocks the locking means 20 such that the first member 4 and the second member 10 spread apart at the hinge 14. The user than positions a lock of hair between the first and second members 4, 10 and above or adjacent the bridge member 22, and then close the first and second members 4, 10 such that they are locked together at the locking means 20. Due to the presence of the bridge member 22, the bridge member 22 engages with the lock of hair such that it is tightly secured between the bridge member 22 and the second member 10. Due the presence of the spikes 36, the spikes actually penetrate the lock of hair to some extent, thus increasing the mechanical grip and frictional grip to the hair, thus reducing the chance that the lock of hair would unintentional or accidentally disengage from the clip or become loosen. Due to the inherent flexibility of the bridge member 22, it actually flexes slightly towards the inwardly facing surface 8 of said first member 4 in use when under pressure from the lock of hair during hair clipping; however, due to the profile of the bridge member 22 it is mechanically biased towards hair being held such that the hair can be held tight.

The configuration of the clip 2 is advantageous in multifold. First, the provision of the frictional portion 34 made of a softer material increases the frictional engagement between the lock of hair being secured and the clip 2. Second, the three-dimensional profile of the bridge member 22 in the form of spikes in this embodiment allows penetration into the lock of hair which further increases gripping of the hair. Third, the bridge member is springy which allows it to spring towards or press against the hair due to the inherent material and structural property, thus further minimize loosening of the hair from the clip 2. The dual material structure of the bridge member 22 provides on one hand the necessary stiffness and springiness of the overall structure and on the other hand the increased frictional grip of the frictional portion or the second material. Overall, the bridge member 22 is relatively firm, and yet, sufficiently flexible so as to provide a flexibility or flexural springy effect. This increases the tolerance of the clipping device such that it can not only secure a lock of hair more reliably but also can accommodate different volume of hair.

FIGS. 8*a* to 14 show a second embodiment of a hair clip 102 according to the present invention. This hair clip 102 is generally similar the clip 2. For sake of brevity and clarity, only major differences are illustrated. One main difference is that, as clearly shown in for example FIG. 10, a bridge member 122 is provided but without having any spikes. Nevertheless, an interior portion is provided with a number of openings 136 which likewise increase frictional engagement with hair.

FIGS. 15*a* to 23 show a third embodiment of a hair clip 202 according to the present invention. The hair clip 202 is similar to the hair clip 2 in some ways. For sake of brevity and clarity, only major differences are illustrated. The hair clip 202 likewise has a first member 204 and a second member 210 but they instead resemble a pair of claws. The first member 204 and the second member 210 are hingedly connected together, for opening or closing of the claws although they are biased to close to secure hair therebetween. Similar to the hair clips 2, 102 in the first and second embodiments, the hair clip 202 likewise has a bridge member 222 with spikes 236 extended therefrom. One main difference is that each of the first member 204 and the second member 210 is provided with such bridge member 222. The bridge members 222 are positioned such that on closing of the claws, they together are adapted to grip a lock of hair, similar to a pair of jaws gripping onto an object. Since the cavity defined between the claws 204, 210 are larger, this hair clip 202 can grip a larger lock of hair. Also due the provision of two oppositely arranged bridge members 222, the hair clip 202 can secure a lock of hair more tightly.

Figure 15A:
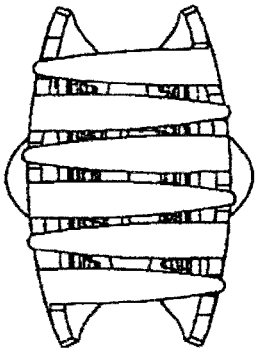
FIGS. 15*a* to 15*f* are a bottom view, a side view a top view, the opposite side view and two perspective views of another embodiment of a hair clip, respectively.
Figure 15B:
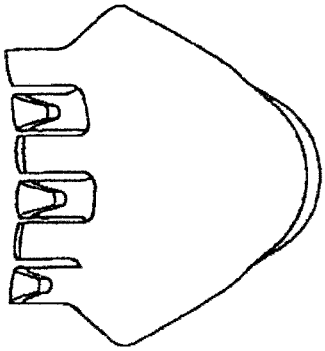
Figure 15C:
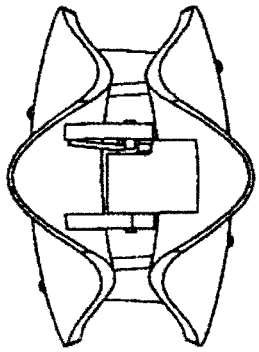
Figure 15D:
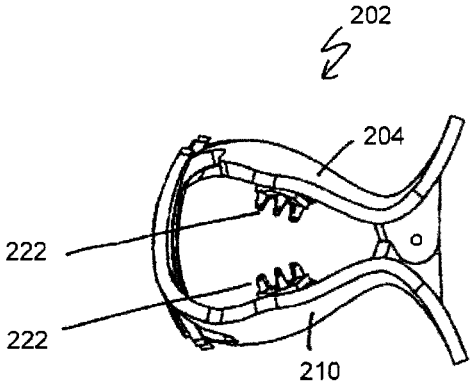
Figure 15E:
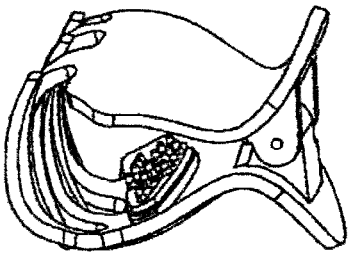
Figure 15F:
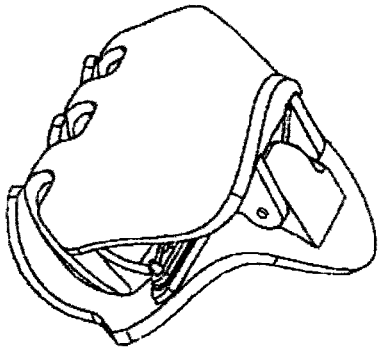
Figure 16A:
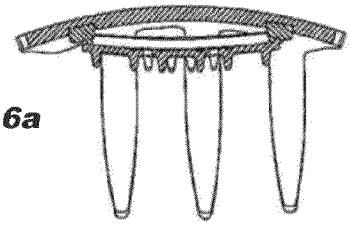
FIGS. 16*a* to 16*f* are a cross section view, a top view, a side view and bottom view, a perspective view and another side view of one half of the hair clop of FIG. 15*a*, respectively.
Figure 16E:
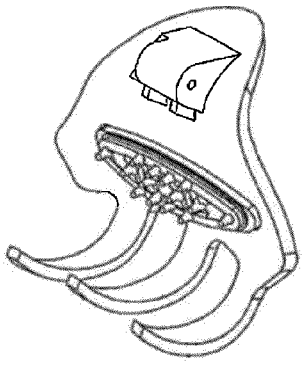
Figure 16B:
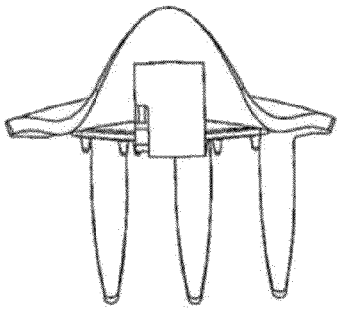
Figure 16C:
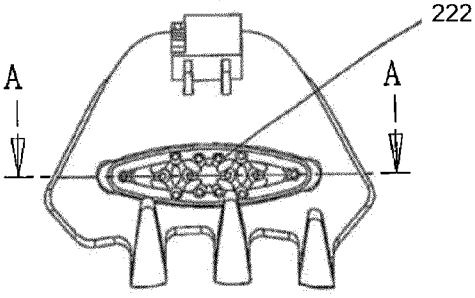
Figure 16F:
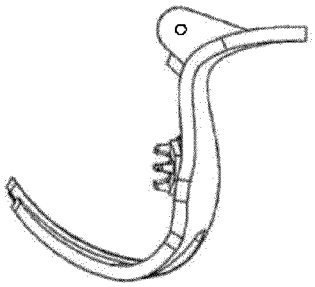
Figure 16D:
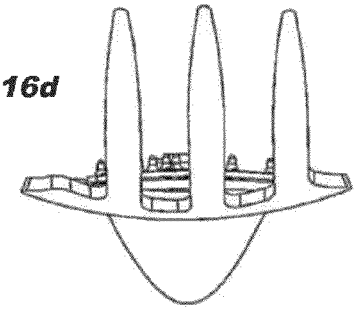
Figure 17:
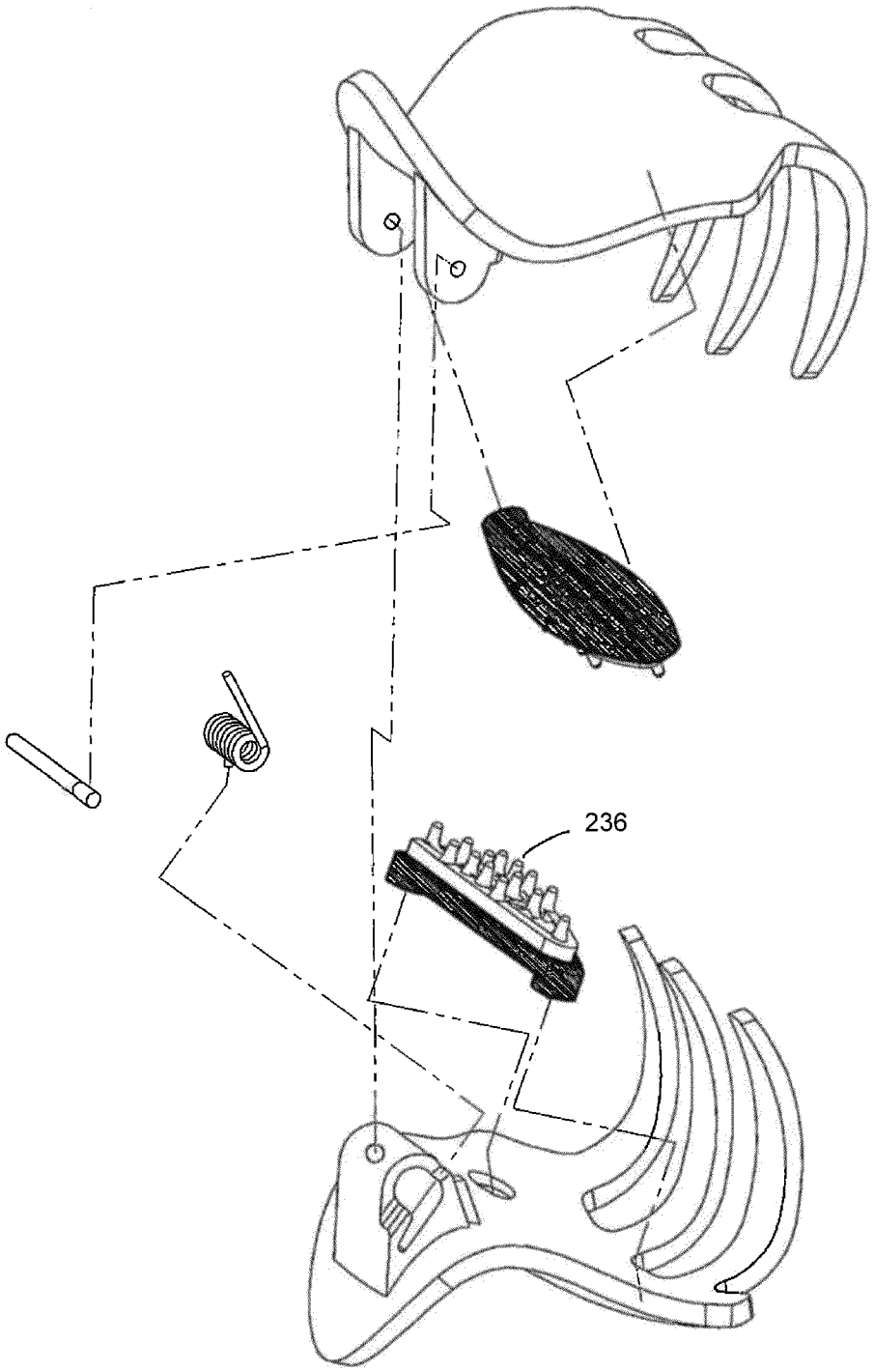
FIG. 17 is an exploded view of the hair clip of FIG. 15*a;*
Figure 18:
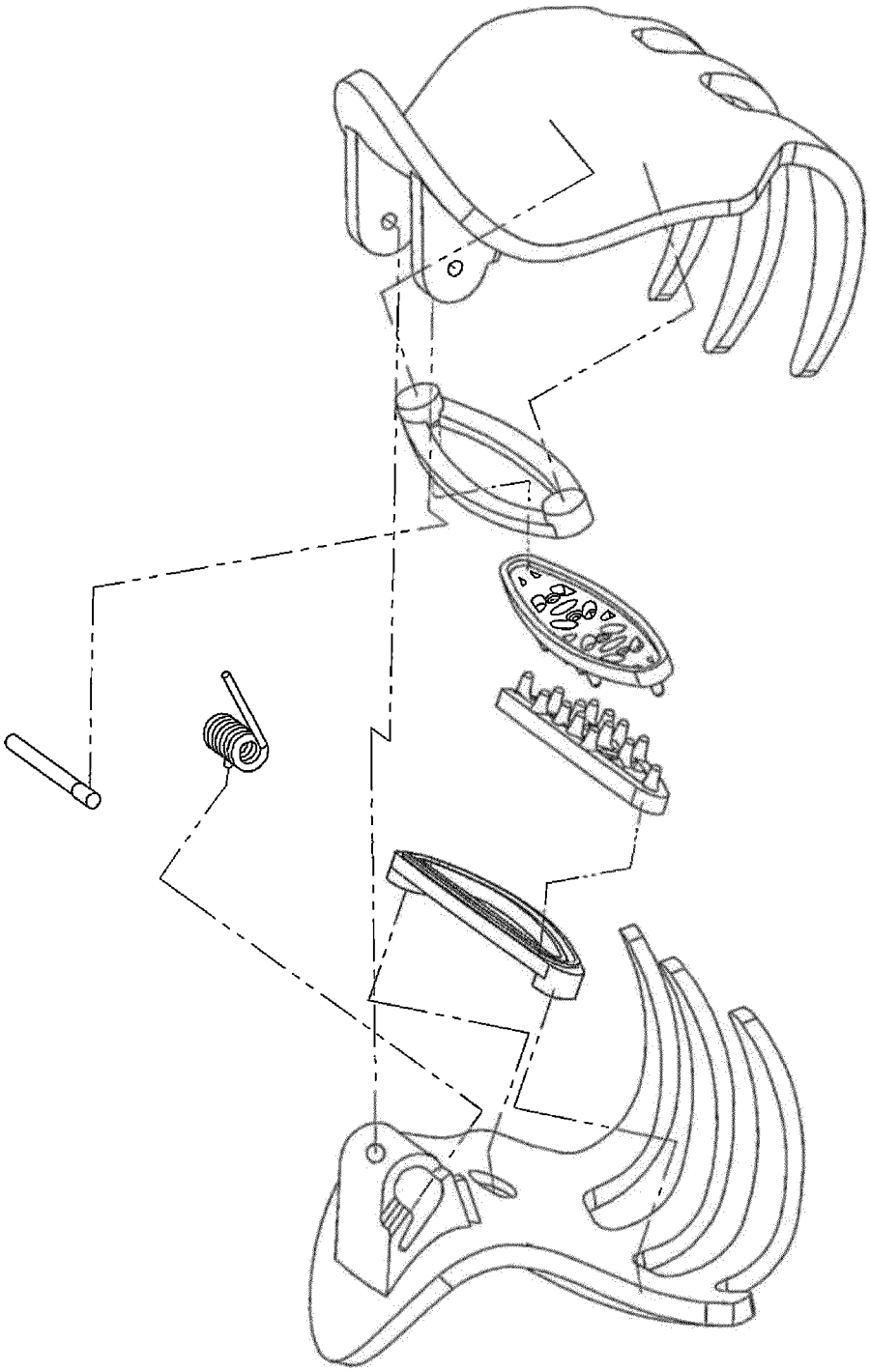
FIG. 18 is another exploded view of the hair clip of FIG. 15*a;*
Figure 19:
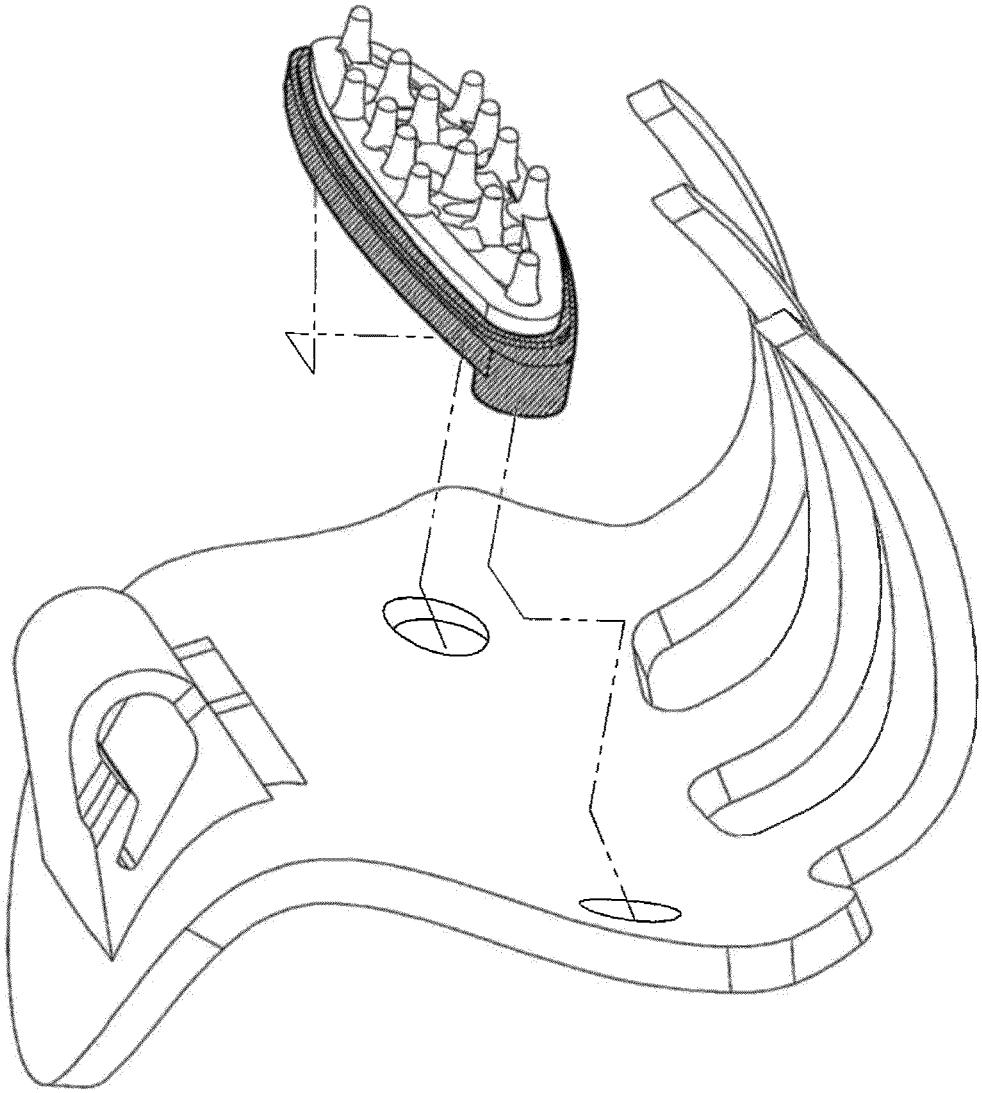
FIG. 19 is a perspective exploded view of the half clip of FIG. 16*a;*
Figure 20:
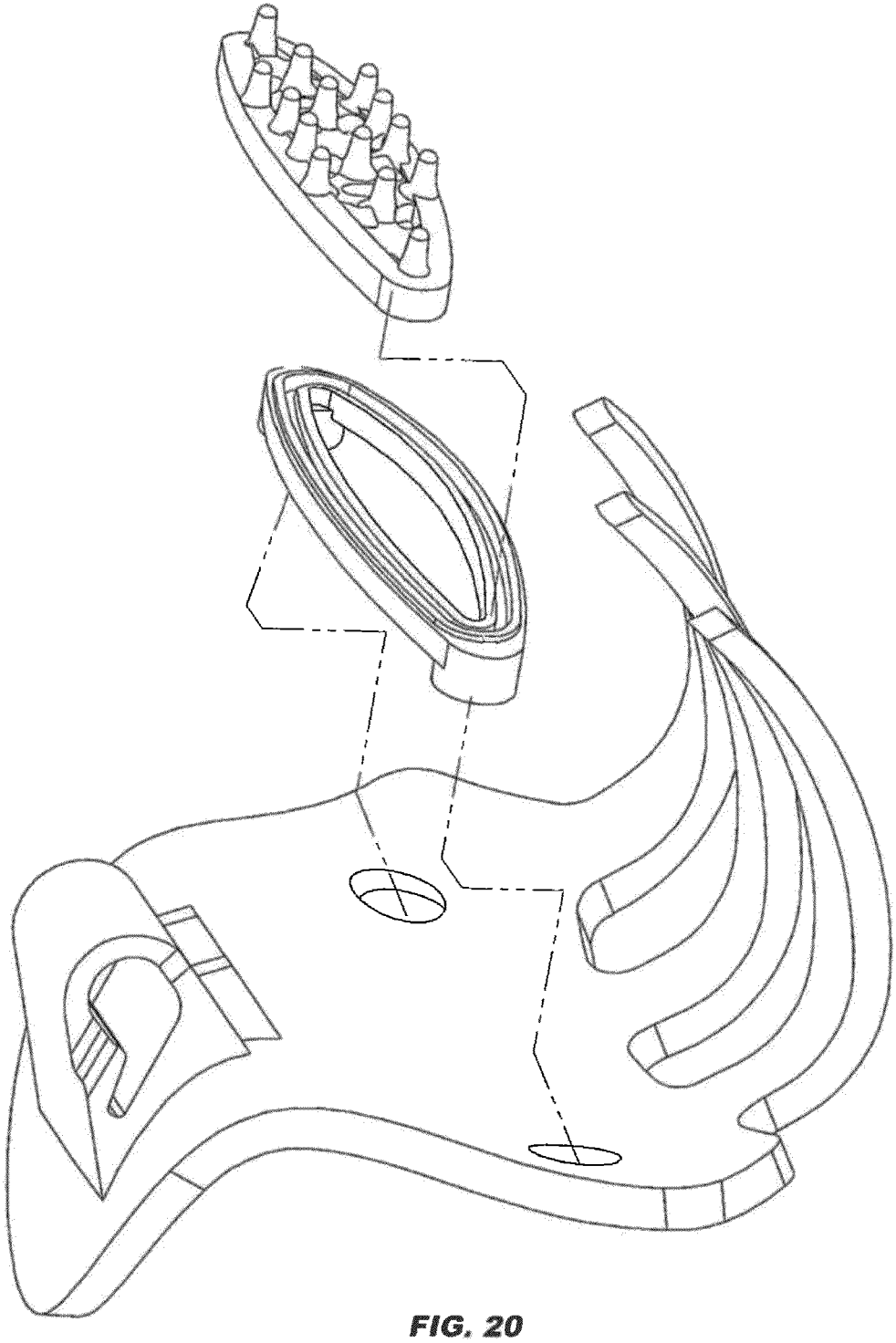
FIG. 20 is a perspective exploded view of the half clip of FIG. 16*a;*
Figure 21A:
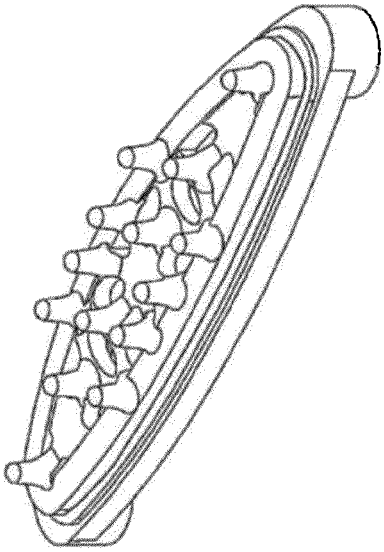
FIGS. 21*a* to 21*e* are a perspective view, a side view, a top view, another side view and a bottom view of a bridge member of the hair clip of FIG. 15*a*, respectively.
Figure 21B:
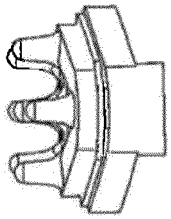
Figure 21C:
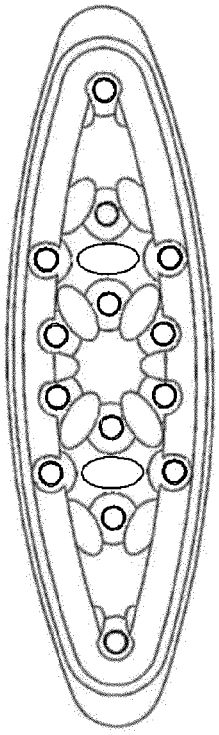
Figure 21D:
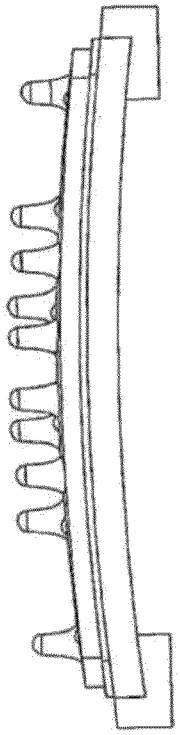
Figure 21E:
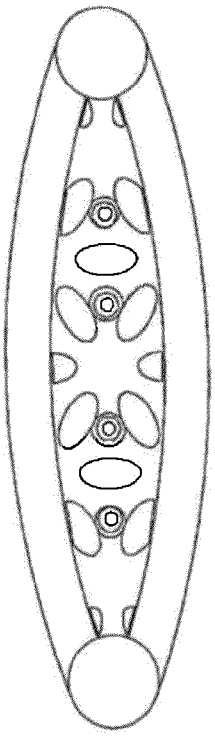
Figure 22A:
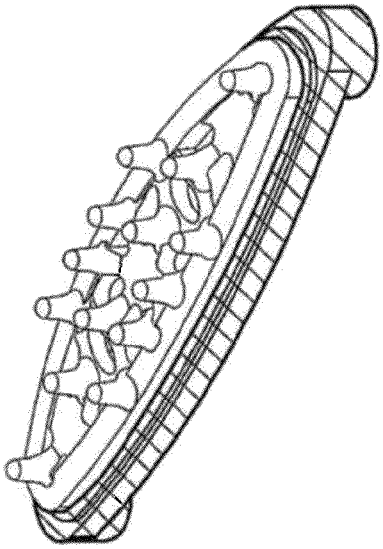
FIGS. 22*a* to 22*e* are, similarly, a perspective view, a side view, a top view, another side view and a bottom view of a bridge member of the hair clip of FIG. 15*a*, respectively.
Figure 22B:
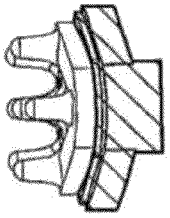
Figure 22C:
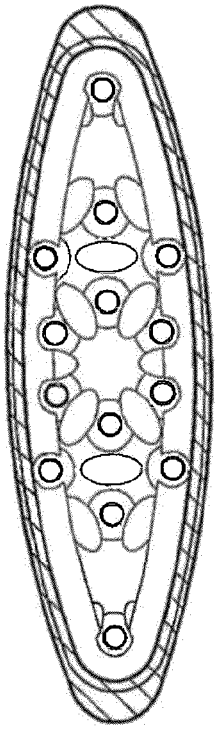
Figure 22D:
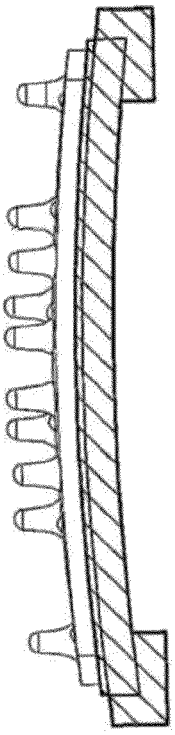
Figure 22E:
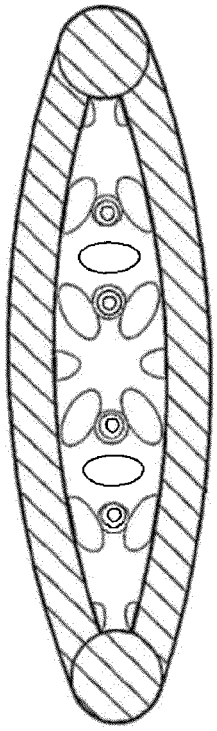
Figure 23:
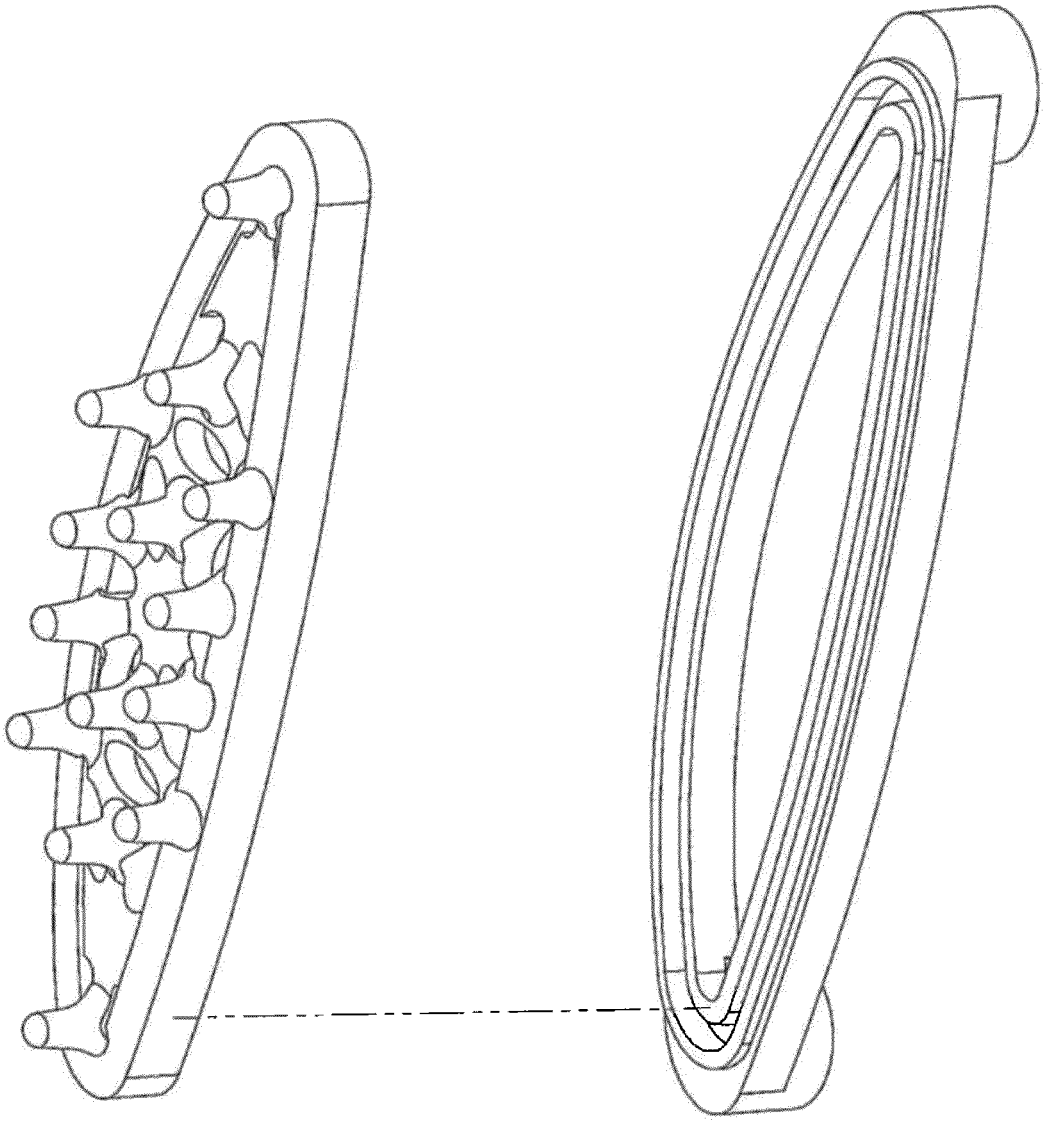
FIG. 23 is an exploded view of the bridge member of FIG. 21*a;*
Figure 24A:
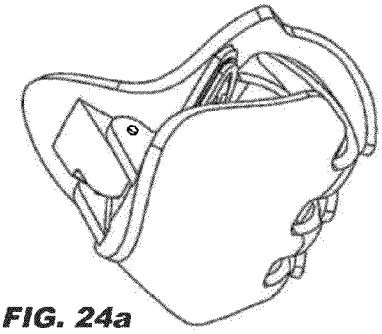
FIGS. 24*a* to 24*f* are a bottom view, a side view a top view, the opposite side view and two perspective views of another embodiment of a hair clip, respectively.
Figure 24B:
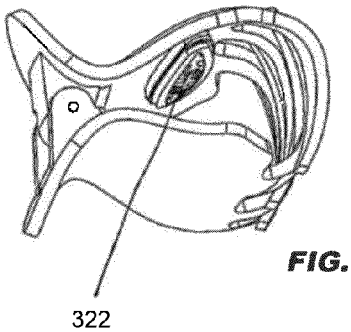
Figure 24C:
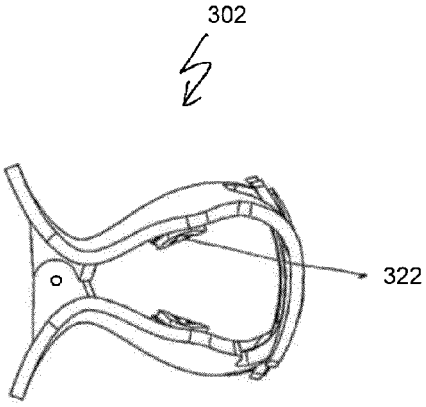
Figure 24D:
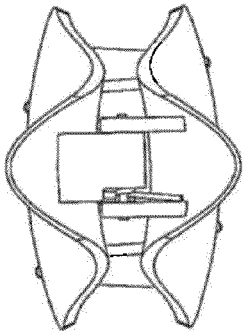
Figure 24E:
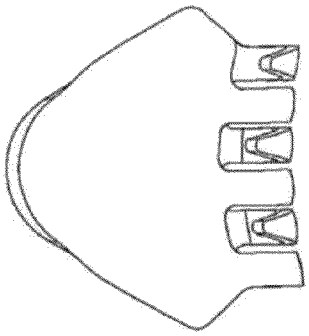
Figure 24F:
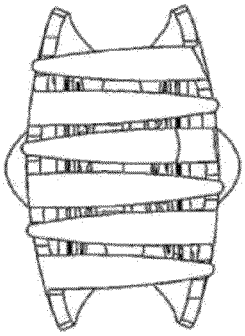
Figure 25A:
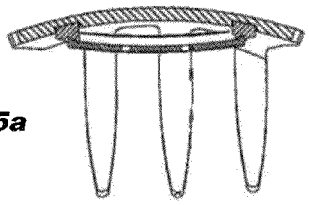
FIGS. 25*a* to 25*f* are a cross section view, a top view, a side view and bottom view, a perspective view and another side view of one half of the hair clop of FIG. 24*a*, respectively.
Figure 25B:
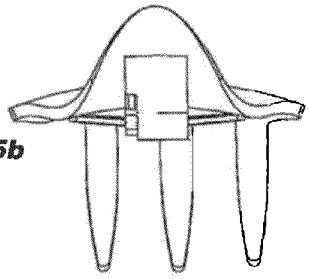
Figure 25E:
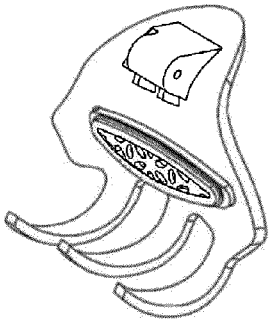
Figure 25C:
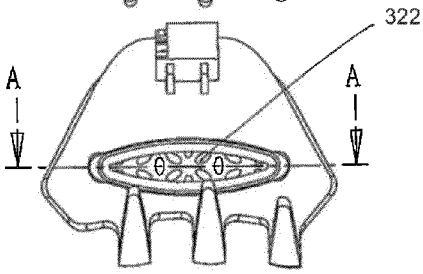
Figure 25F:
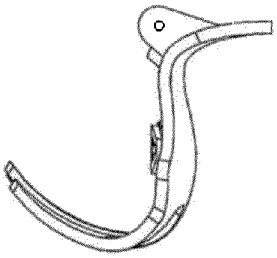
Figure 25D:
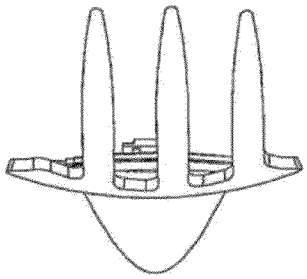
Figure 26:
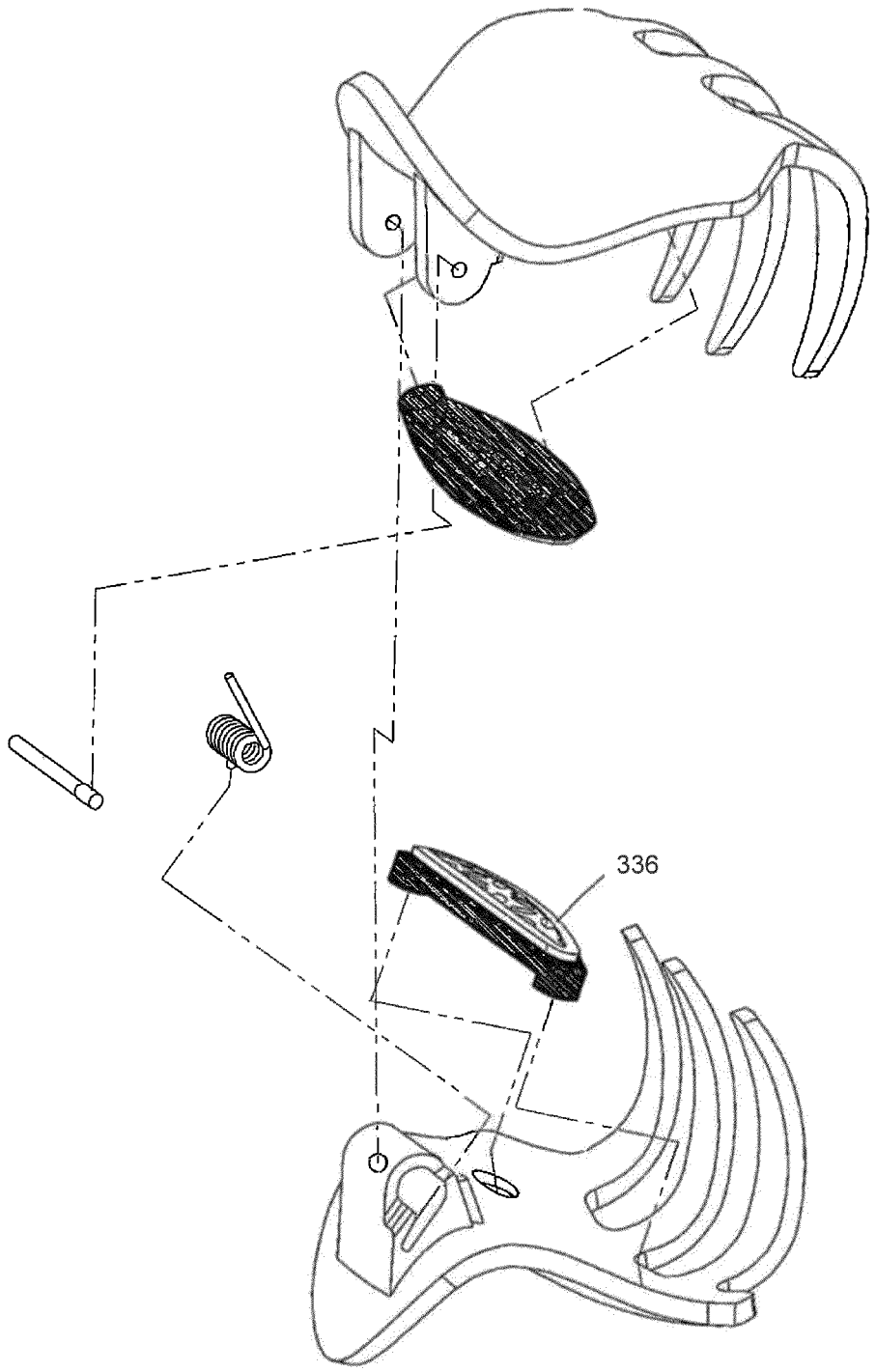
FIG. 26 is an exploded view of the hair clip of FIG. 24*a;*
Figure 27:
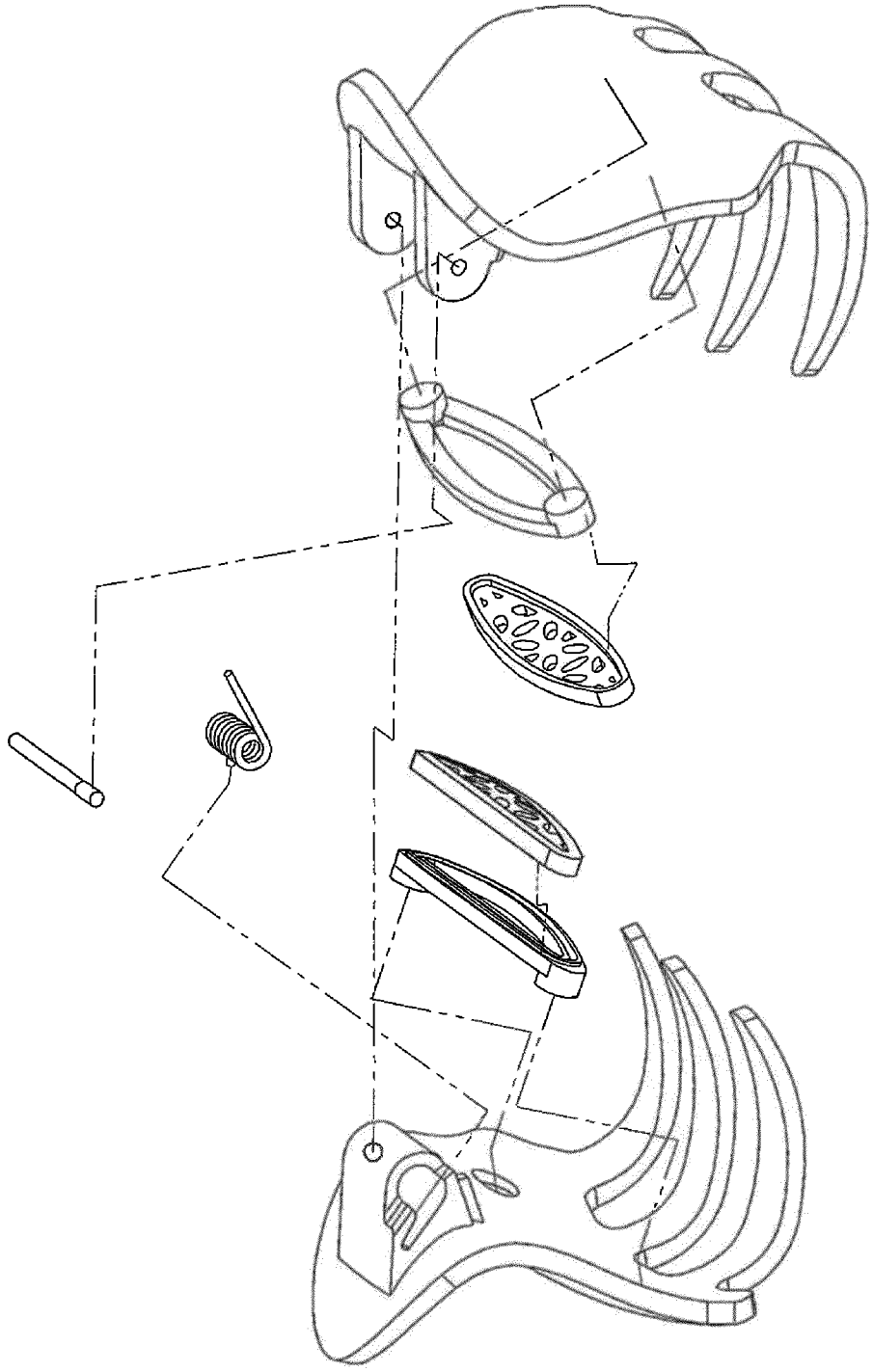
FIG. 27 is another exploded view of the hair clip of FIG. 24*a;*
Figure 28:
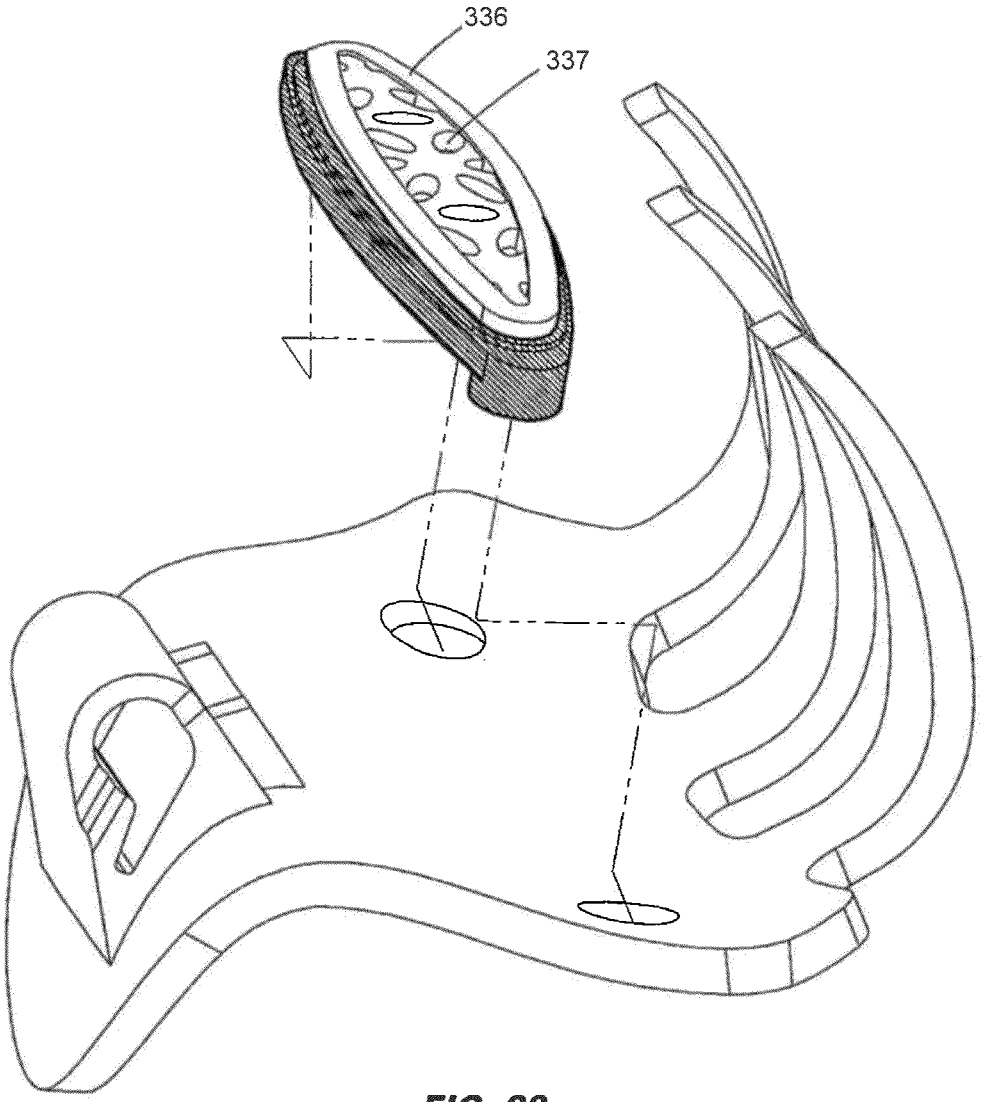
FIG. 28 is a perspective exploded view of the half clip of FIG. 25*a;*
Figure 29:
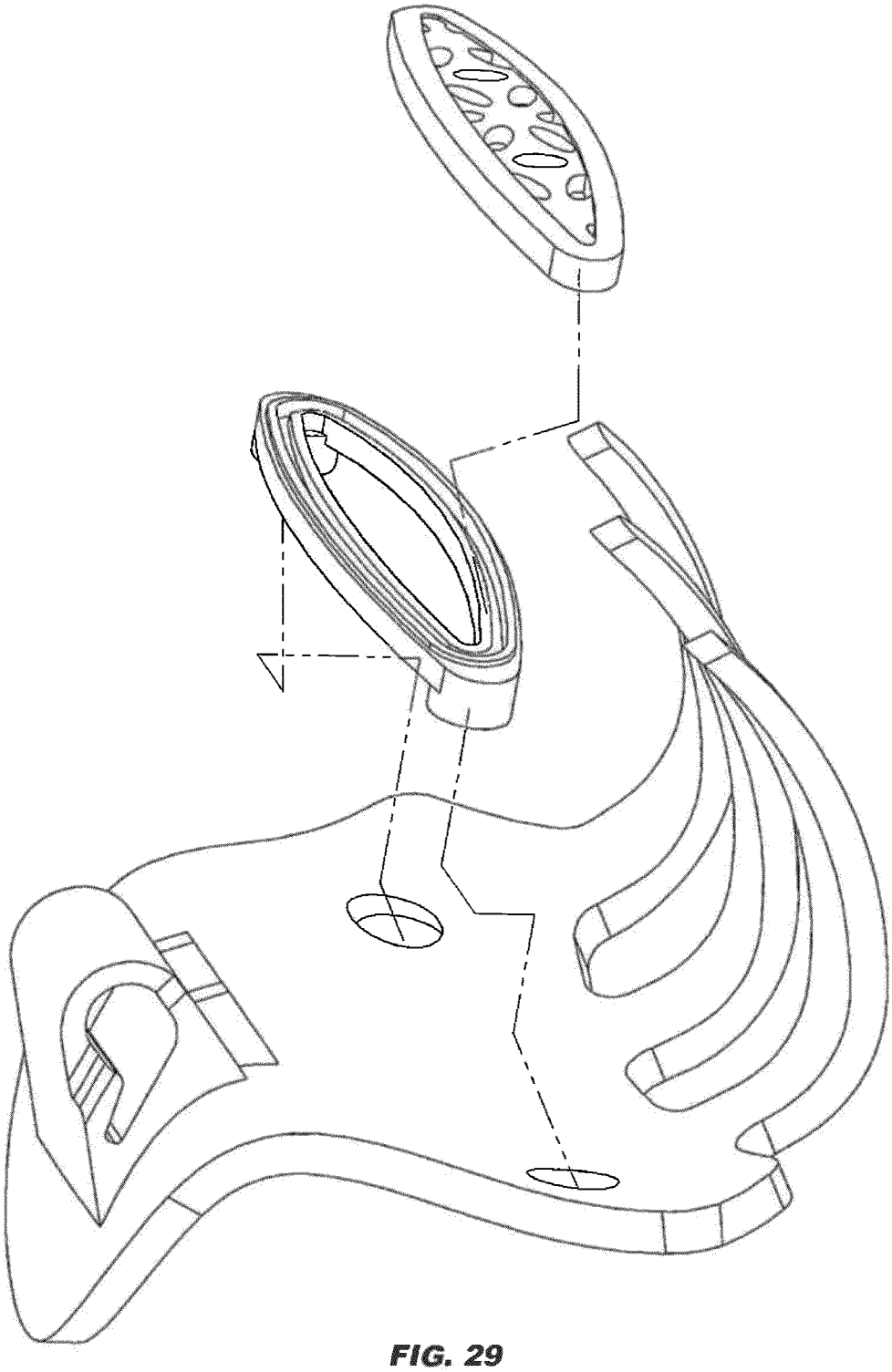
FIG. 29 is a perspective exploded view of the half clip of FIG. 25*a;*
Figure 31A:
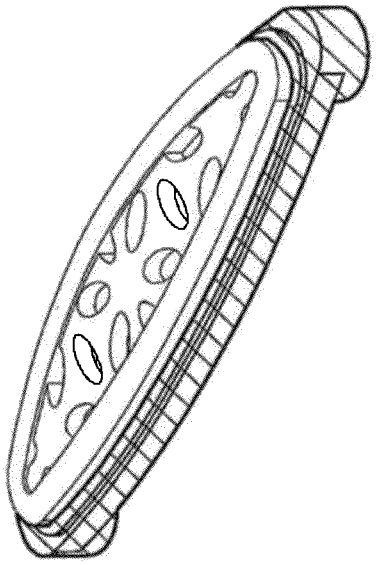
FIGS. 31*a* to 31*e* are, similarly, a perspective view, a side view, a top view, another side view and a bottom view of a bridge member of the hair clip of FIG. 24*a*, respectively.
Figure 31B:
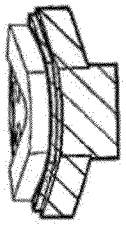
Figure 31C:
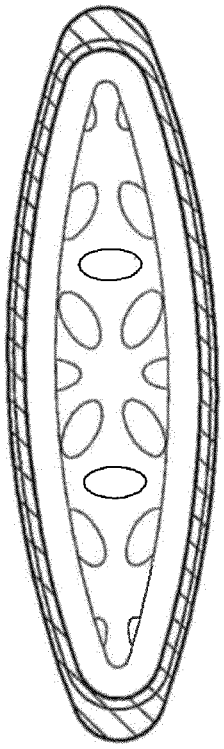
Figure 31D:
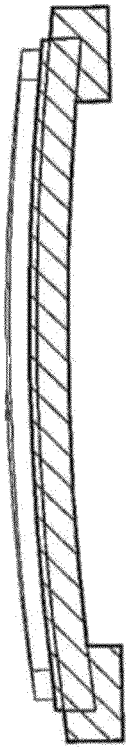
Figure 31E:
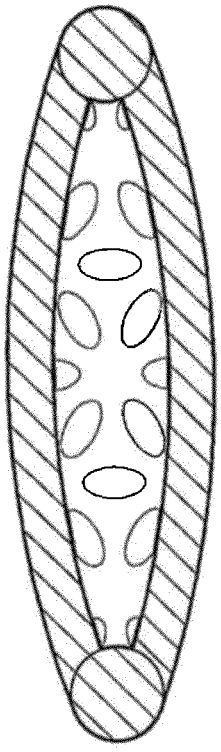
Figure 32:
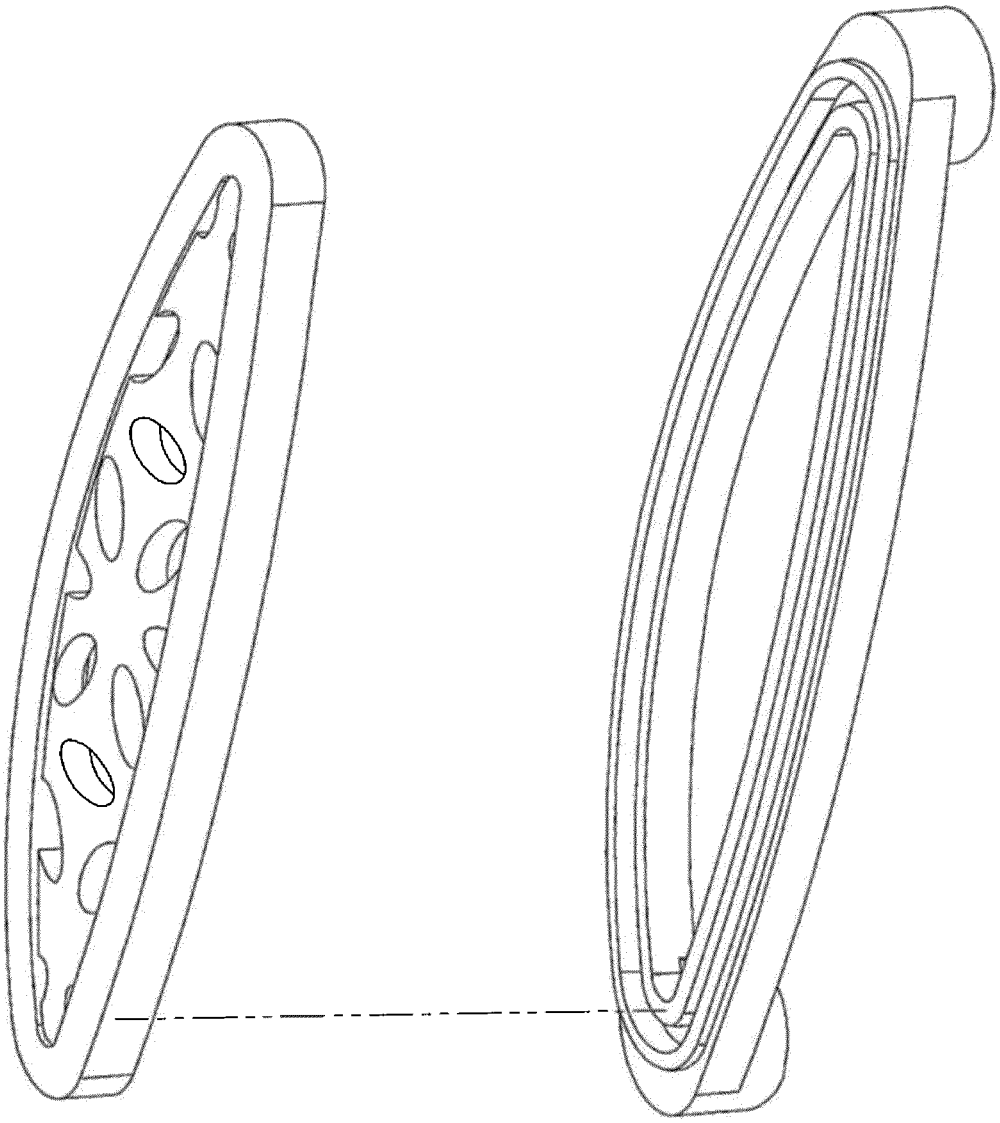
FIG. 32 is an exploded view of the bridge member of FIG. 30*a;*

FIGS. 24*a* to 32 show an embodiment of a hair clip 302 similar to the one in the third embodiment (FIG. 15*a*). The hair clip 302 is similar to the hair clip 202. For sake of brevity and clarity, only major differences are explained. One difference is that a bridge member 322 without spikes is provided. Instead of spikes, as shown in for example FIG. 30*a*, the bridge member 322 is provided with a peripheral lip 336 for better gripping onto hair in use. The interior portion likewise is provided with a number of apertures 337 for increasing frictional contact technically, but in a specific pattern aesthetically.

It should be understood that certain features of the invention, which are, for clarity, described in the content of separate embodiments, may be provided in combination in a single embodiment. Conversely, various features of the invention which are, for brevity, described in the content of a single embodiment, may be provided separately or in any appropriate sub-combinations. It is to be noted that certain features of the embodiments are illustrated by way of non-limiting examples. For example, while the bridge member as illustrated in the aforementioned embodiments are elongate, other suitable profiles or length of the bridge member may also be used. Also, a skilled person in the art will be aware of the prior art which is not explained in the above for brevity purpose.

The invention claimed is:

1. A hair clipping claw device comprising a first claw member defining an outwardly facing surface and an inwardly facing surface and having a number of fingers extending therefrom, a second claw member movably connected to said first claw member defining an inwardly facing surface and also having a number of fingers extending therefrom and arranged alternately with the fingers from the first claw member, and an elongate bridge made of plastic and with opposite ends attached to said first claw member and raised from the inner surface of said first claw member via a pair of feet as connectors at said opposite ends, wherein said bridge includes a frame portion made of a first material and an interior portion made of a second material, wherein said interior portion is softer than said frame portion and provided with an increased frictional surface when compared to said frame portion, wherein said bridge comprises a plurality of spikes extending away from the inwardly facing surface of said first claw member and penetrating into hair being clipped in use, and provided with openings, for increased mechanical gripping of the hair in use; and said connectors have a cylindrical configuration for connecting said bridge member to said first claw member but at the same time raising said bridge member from the inwardly facing surface of said first claw member.

2. A hair clipping claw device as claimed in claim 1, wherein said bridge runs along a longitudinal axis of said hair clipping claw device.

3. A hair claw clipping device as claimed in claim 1, wherein a clearance is defined between said bridge and said first claw member.

4. A hair claw clipping device as claimed in claim 3, wherein said bridge is flexible towards the inwardly facing surface of said first claw member when under pressure from hair during hair clipping, and wherein in use said bridge is mechanically biased towards hair being held between said first claw member and said second claw member.

5. A hair clipping claw device as claimed in claim 1, wherein said bridge is mechanically springy.

6. A hair clipping claw device as claimed in claim 1, wherein said frame portion and said interior portion are connected together by snap-fitting or gluing.

7. A hair clipping claw device as claimed in claim 1, wherein said spikes points away from the inwardly facing surface of said first claw member or towards said second claw member for increased grip of hair by said spikes and/or between said bridge and said second claw member.

8. A hair clipping claw device as claimed in claim 1, wherein said bridge is provided with a number of apertures thereon.

9. A hair clipping claw device as claimed in claim 1, wherein said elongate bridge has a length ranging from substantially 18 mm to 40 mm.

10. A hair clipping claw device as claimed in claim 1, comprising a hinge at one end thereof for connecting said first claw member and said second claw member together allowing said device to swing open for receiving a lock of hair in use.

11. A hair clipping claw device as claimed in claim 1, wherein said bridge comprises a first bridge and further comprising a second bridge, said first bridge arranged on said first claw member and said second bridge arranged on said second claw member, wherein the position of said bridges is such that on assembly of said first and second claw members, said bridges cooperatively secure a lock of hair therebetween.

* * * * *